US006051894A

United States Patent [19]

Shimogama

[11] Patent Number: 6,051,894

[45] **Date of Patent: *Apr. 18, 2000**

[54] SAFETY DEVICE OF INDUSTRIAL ROBOT

[75] Inventor: Shigeru Shimogama, Kawanishi, Japan

[73] Assignee: Matsushita Electric Industrial Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/918,430

[22] Filed: Aug. 26, 1997

[30] Foreign Application Priority Data

Aug. 28, 1996 [JP] Japan ..... 8-226326

[51] Int. Cl.[7] ..... H01H 47/00

[52] U.S. Cl. ..... 307/125; 307/130; 361/2; 361/79

[58] Field of Search ..... 307/113, 115, 307/139, 140, 326–328, 112, 114, 116, 142, 125, 126, 130, 131, 137; 361/78, 79, 115, 160, 166, 167, 170, 193, 189–191, 1–3, 5–9, 13

[56] References Cited

U.S. PATENT DOCUMENTS

| | | | |
|---|---|---|---|
| 4,644,438 | 2/1987 | Puccinelli et al. | 361/75 |
| 4,965,694 | 10/1990 | Dvorak et al. | 307/41 |
| 5,194,858 | 3/1993 | Erwin | 340/825.7 |
| 5,258,885 | 11/1993 | Hattori et al. | 361/79 |
| 5,267,120 | 11/1993 | Graff et al. | 361/185 |
| 5,357,394 | 10/1994 | Piney | 361/72 |
| 5,406,270 | 4/1995 | Van Lente | 307/10.1 |
| 5,633,540 | 5/1997 | Moan | 307/126 |
| 5,818,681 | 10/1998 | Futsuhara et al. | 361/179 |

*Primary Examiner*—Stephen W. Jackson
*Assistant Examiner*—Peter Zura
*Attorney, Agent, or Firm*—Ratner & Prestia

[57] ABSTRACT

The safety device of industrial robot of the invention is intended to assure safety of the operator for teaching operation of an industrial robot.

In the safety device of the industrial robot of the invention, a switch having two contacts working simultaneously is used as the dead-man's switch provided in the teaching pendant, and by monitoring the open or closed state of the two contacts working simultaneously, fusion of contact is judged by miss-matching of the opening and closing action, and the operation of the robot is stopped immediately. Besides, as an over-travel switch for actuating when the robot main body gets out of the normal moving range, a switch having two contacts working simultaneously is used, and by monitoring the open or closed state of the two contacts working simultaneously, fusion of contact is judged by miss-matching-of the opening and closing state, and the operation of the robot is stopped immediately.

Moreover, in the safety device of the industrial robot of the invention, it is constituted to detect individually the energized state of the coils of the relays for composing the safety circuit responsible for emergency stop, and the open and closed state of these relay contacts, and fusion of contact is judged by miss-matching of the coil energized state and the open and closed state of the contacts, so that the operation of the robot is stopped immediately.

8 Claims, 3 Drawing Sheets

SAFETY DEVICE OF INDUSTRIAL ROBOT

BACKGROUND OF THE INVENTION

The present invention relates to a safety device of an industrial robot for-assuring safety of operator teaching closely to a robot main body.

Generally, in the industrial robot of teaching playback system, in order to teach the robot, a teaching pendant (TP) is used as a portable console. This teaching pendant is useful for teaching while moving the robot finely by directly observing a control point (end effector) of the industrial robot by the teaching operator, and most teaching pendants are designed to be held by one hand and operate for teaching by other hand.

This teaching pendant is provided with a dead-man's switch for assuring safety of the teaching operator. Only while the teaching operator is pressing this dead-man's switch, the servo power source is supplied and teaching operation is enabled. When the teaching operator releases this dead-man's switch, the servo power source for driving the servo motor is cut off, and the shaft of the servo motor is braked at the same time, and the robot stops immediately, so that the safety of the teaching operator is protected.

The robot main body is limited in a range of motion by the software, and an over-travel switch is provided outside of the motion range by the software. In case, due to some abnormality, the robot moves out of the range, the over-travel switch is opened to cut off the servo power source for driving the servo motor, and the servo motor is braked to stop the robot immediately, so that dangerous runaway can be prevented.

Moreover, according to a safety circuit, by the input from a door switch which opens the circuit when the door of safety fence is opened, an emergency stop push-button switch provided in the teaching pendant, or an emergency stop push-button switch provided in the operation panel or outside, the servo power source for driving the servo motor is cut off, and the servo motor is braked, thereby bringing the robot into an emergency stop.

A conventional safety switch of industrial robot is described below while referring to FIG. 3.

In FIG. 3, when a teaching pendant enable switch 10 is closed, the servo power source can be turned on at the teaching pendant side. That is, if there is no other disturbing factor, the servo power source can be turned on by pressing a dead-man's switch 101 of the teaching pendant.

When the teaching pendant enable switch 10 is closed, the central processing unit (CPU) sets a teach disable signal 19 in low logic, and a relay coil CR1 is not energized. That is, a contact CR1*a* is open, and a contact CR1*b* is closed, and a signal line 101*a* connected to the dead-mPn's switch 101 provided in a teaching pendant 4 is connected to a grounding line PG through the contact of the dead-man's switch 101 and relay contact CR1*b*. Since the signal line 101*a* is connected to the CPU through a photo coupler, when there is a conduction between the signal line 101*a* and grounding line PG, the CPU recognizes that the dead-man's switch 101 is closed.

When the dead-man's switch 101 is closed in the closed state of the teaching pendant enable switch 10 of the teaching pendant 4, the CPU sets the servo power source ON signal 13 to high logic, and a relay coil CR13 is energized, and its contact CR13*a* is closed. On the other hand, when the dead-man's switch 101 is closed, a relay coil CR2 is energized, and its contact CR2*a* is closed. Therefore, as far as there is no impeding factor for turning on the servo power source (for example, in the case of the apparatus in FIG. 3, when an over-travel switch 105 is open, a door switch input 106 of safety fence is open, an external emergency stop input 107 is open, or an emergency stop input 104 of the teaching pendant 4 is open), all of the relay contacts CR18*a*, CR14*a*, CR17*a*, CR16*a*, CR13*a*, and CR2*a* are closed, and a voltage (+DC 24 V in the example in FIG. 3) is applied to the line of a servo power source ON enable signal 12, so that the servo power source can be turned on.

In a robot main body 1, moreover, the moving range is limited usually by the software, and the over-travel switch 105 is provided outside of the moving range by this software, and if the robot gets out of this range due to some abnormality, the over-travel switch 105 is opened. As the over-travel switch 105 is opened, the signal line 105*a* is cut off from the grounding line PG. Since the signal line 105*a* is connected to the CPU through the photo coupler, as the signal line 105*a* is cut off from the grounding line PG, the CPU recognizes that the over-travel switch 105 is opened, and sets the servo power source ON signal 13 to low logic, and hence the relay coil CR13 is de-energized, thereby opening its contact CR13*a*, and the line of the servo power source ON enble signal 12 has no voltage and the servo power source is cut off. As the servo power source is cut off, it is designed so that the servo motor is braked, and thereby the robot is brought into an emergency stop, so that -dangerous runaway of the robot can be avoided.

The door switch input 106, emergency stop input 104 of teaching pendant 4, external emergency stop input 107, and panel emergency stop input 108 are normally closed contact signals with no voltage, and the relay coils CR16, CR14, CR17, and CR18 are energized. These relay contacts CR16*a*, CR14*a*, CR17*a*, and CR18*a* are connected in series, and are further connected to the line of the servo power source ON enable signal 12 through the relay contacts CR13*a* and CR2*a* . When the external contact of the normally closed circuit of any one of the door switch input 106, emergency stop input 104 of the teaching pendant 4, external emergency stop input 107, and panel emergency stop input 108 is opened, one of the relay coils CR16, CR14, CR17 and CR18 is deenergized, and any one of the relay contacts CR16*a*, CR14*a*, CR17*a*, and CR18*a* is opened, and the line of the servo power source ON enable signal 12 has no voltage, and the servo power source is cut off. When the servo power source is cut off, it is designed so that the servo motor is braked, and the robot is stopped immediately, and danger is avoided.

Thus, the safety device of the industrial robot is composed of micro switch contacts as dead-man's switch and over-travel switch and relay contacts. Depending on opening and closing of the micro switch contacts and relay contacts, the servo power source of the industrial robot is turned on or cut off. In the conventional safety device of industrial robot, however, since the servo power source is controlled by using a single contact, if fusion occurs in the contacts, emergency stop signals of dead-man's switch, overtravel switch and others are not normally transmitted, and specified function cannot be executed, and safety cannot be assured, which was a fatal defect.

SUMMARY OF THE INVENTION

In a first embodiment of the invention, the safety device of industrial robot comprises a dead-man's switch having two contacts, with these two contacts connected in series and one end of the two contacts connected in series being grounded, and means for cutting off the servo power source when detecting fusion of contacts of the dead-man's switch by checking for presence or absence of voltage between one end of non-grounding side of two contacts in series of the dead-man's switch and the connection point of the two contacts.

In a second embodiment of the invention, the safety device of industrial robot comprises:

an over-travel switch having two contacts, with these two contacts connected in series and one end of the two contacts connected in series being grounded, and means for cutting off the servo power source when detecting fusion of contacts of the over-travel switch by checking for presence or absence of voltage between one end of non-grounding side of two contacts in series of the over-travel switch and the connection point of the two contacts.

In a third embodiment of the invention, the safety device of industrial robot comprises:

a safety checking relay having a contact applied with voltage at one end, to be energized and turned on by a signal from a safety device such as emergency stop push-button, and means for cutting off the servo power source when detecting fusion of relay contact contact by checking for presence or absence of voltage at one end of the voltage non-applied side of the relay contact, and also checking for presence or absence of voltage applied to the excitation coil of the relay.

According to the constitution of the first embodiment, in case the contact of the dead-man's switch is fused and the contact remains closed although the teaching operator has released the dead-man's switch, the CPU detects the fusion of the contact of the dead-man's switch itself, and the servo power source is cut off, and the servo motor is braked, and the robot is stopped immediately, so that the teaching operator can be protected against danger.

According to the constitution of the second embodiment, in case the contact of the over-travel switch is fused and the contact remains closed although the industrial robot is getting out of the normal moving range, the CPU detects the fusion of the contact of the over-travel switch itself, and the servo power source is cut off, and the servo motor is braked, and the robot is stopped immediately, so that the teaching operator can be protected against danger, and mechanical damage of the robot can be avoided.

According to the constitution of the third embodiment, in case the contact of the relay for composing the safety circuit is fused and the contact remains closed, the CPU detects the fusion of the contact of the relay for composing the safety circuit itself, and the servo power source is cut off,and the servo motor is braked, and the robot is stopped immediately, so that danger can be avoided.

DESCRIPTION OF THE PREFERRED EMBODIMENTS

Figure 1:
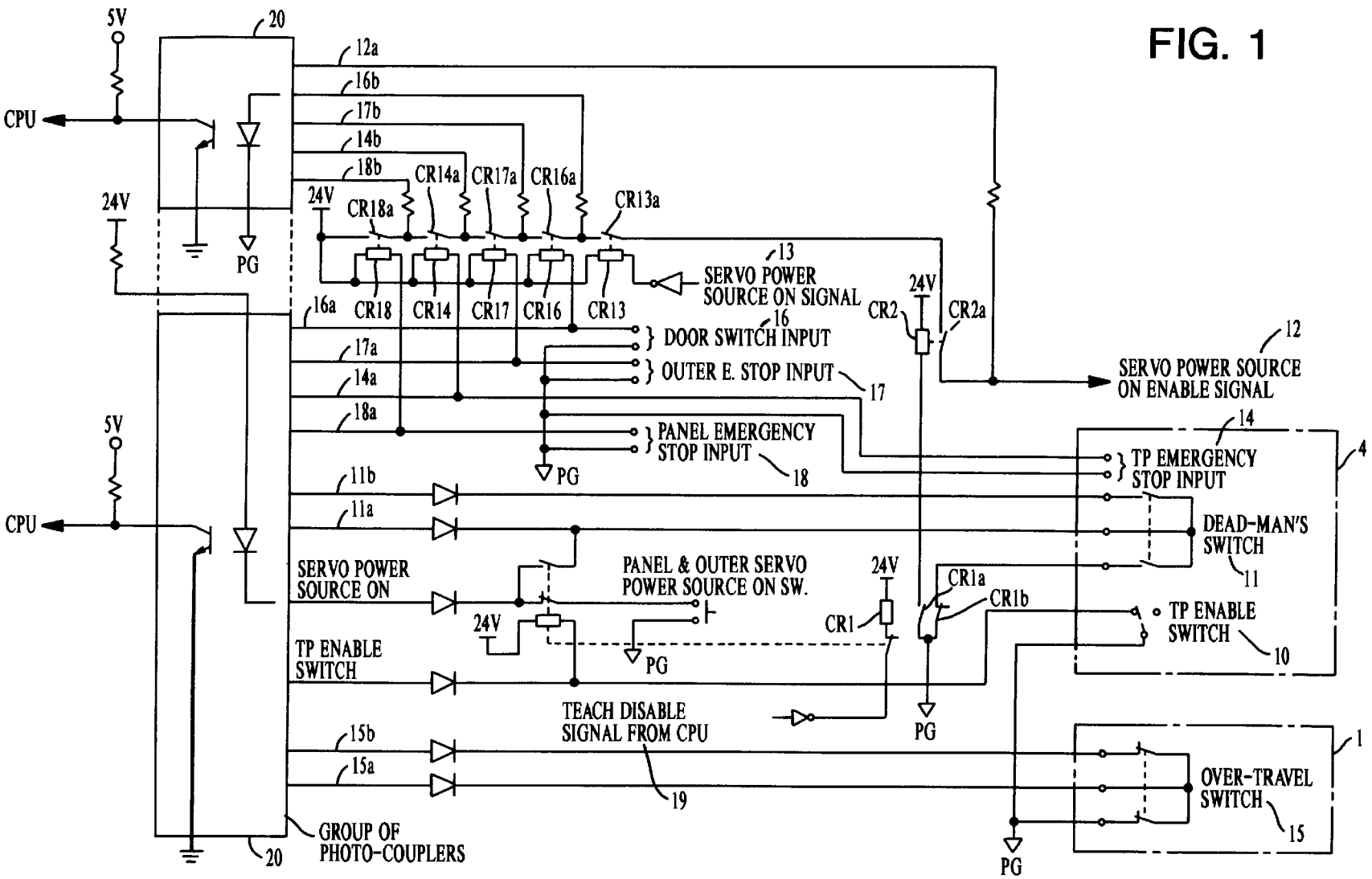
FIG. 1 is an electric circuit diagram of essential parts showing an embodiment of a safety device of an industrial robot of the invention.
Figure 2:
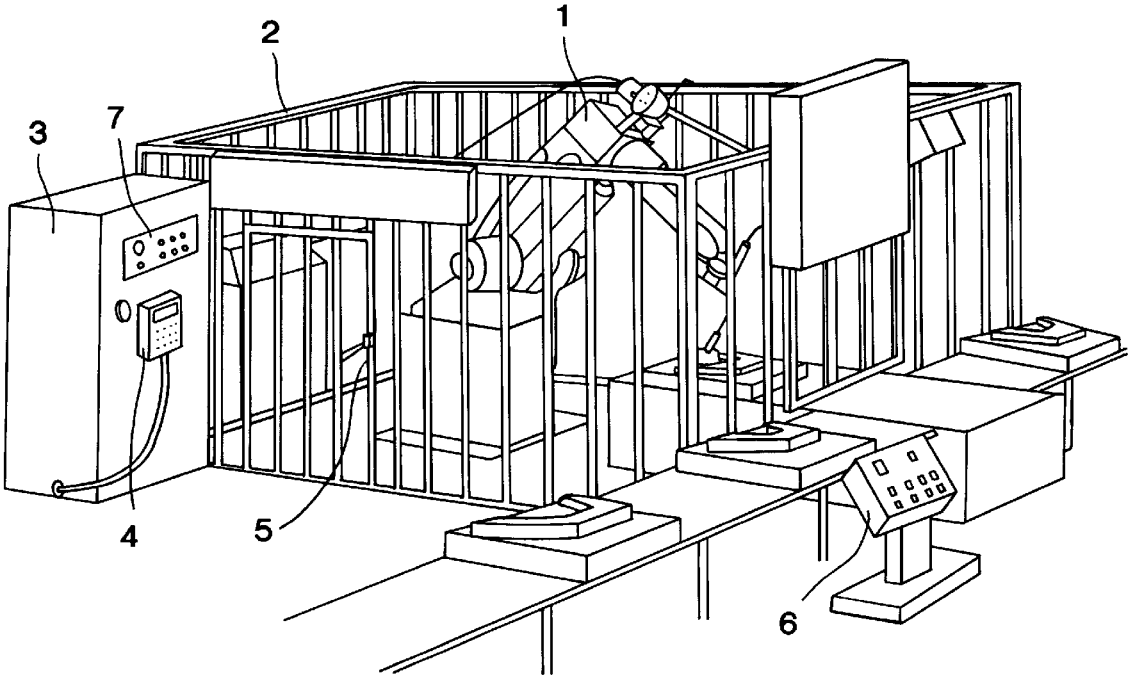
FIG. 2 is a perspective view showing a system configuration of an industrial robot.

Referring now to FIG. 1 and FIG. 2, embodiments of the invention are described below.

Figure 3:
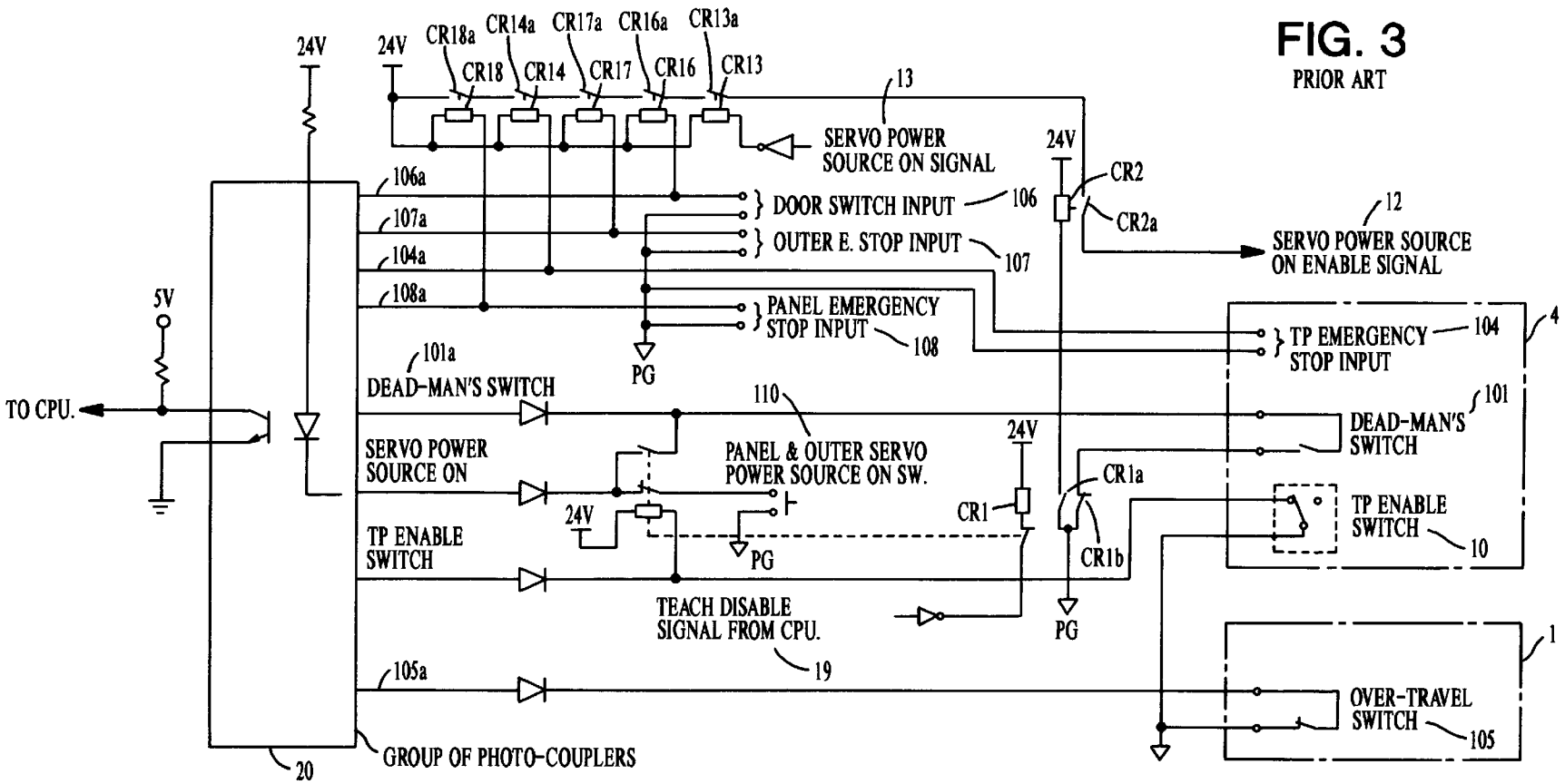
FIG. 3 PRIOR ART
FIG. 3 is an electric circuit diagram of essential parts showing a prior art of safety device of industrial robot.

First, a system configuration of an industrial robot to which the safety device of the invention is applied is explained by referring to FIG. 2. In FIG. 2, reference numeral 1 is a robot mainbody, and it is installed inside enclosed by a safety fence 2. A robot control device 3 and a console 6 are disposed outside of the safety fence 2. In such robot system, in order to teach the robot the procedure of the work to be executed, the teaching operator holds a teaching pendant 4 by hand, and opens a door 5 of the safety fence 2 and gets inside of the safety fence 2. In the industrial robot of teaching playback system, by keeping pressing a dead-man's switch 101 shown in FIG. 3 provided in the teaching pendant 4, the servo power source for driving the robot main body 1 is maintained in the ON state. In this state, by manipulating the move key switch of each action axis provided on the teaching pendant 4, the robot main body 1 is moved, and the end effector is moved so as to conform to the procedure of the work to be executed to teach the position along the moving route, and at the same time necessary input and output commands are stored in each taught position, that is, teaching point. When the teaching work is over, the operator goes outside of the safety fence 2, closes the door 5, and manipulates the operation of the robot main body 1 from the front panel 7 of the robot control device 3 or the console 6.

The front panel 7 of the robot control device 3 contains a push button switch for turning on the servo power source, and when a teaching pendant enable switch 10 (see FIG. 1) of the teaching pendant 4 is open (the teaching pendant side is disabled), the servopower source can be turned on. The front panel 7 also contains various switches for operation of the robot main body 1.

On the other hand, the external console 6 contains an operation switch for turning on or cutting off the supply of primary power source into the industrial robot system, an operation switch for turning on or cutting off the supply of the servo power source into the robot main body 1, a switch for selecting a program to be executed out of plural taught programs, and a switch for starting or stopping the operation of the robot main body 1 by the selected program.

A first embodiment of the safety device of the industrial robot of the invention is described below. In FIG. 1, different from the conventional safety device of industrial robot, in the invention, a switch having two contacts working simultaneously is used as dead-man's switch 11. The two contacts of the dead-man's switch 11 are connected in series, and one end is connected to the grounding line PG through a normally closed contact CR1*b* of the relay CR1, and other end is connected to the CPU through photo coupler by way of signal line 11*b*, The connection point of the two contacts is connected to the CPU through photo coupler by way of signal line 11*a*.

The robot control device also contains other input terminals for feeding door switch signal for confirmed that the door 5 of the safety fence 2 is closed, or feeding signals of plural emergency stop switches provided in various parts, and these input terminals are connected to push-OFF switches for opening the circuit as being pushed by the door when the door is opened, or push-OFF switches for opening the circuit as being pushed by hand. Relay coils are connected to these push-OFF switches, and while the push-OFF switches are closed, the relay coils are energized, and the normally open contacts of the relays are closed. For example, a relay CR16 is connected to a door switch input 16, and when the door switch is closed, the relay CR16 is energized, and its contact CR16*a* is closed. Similarly, relay CR17 is connected to external emergency stop input 17, a relay CR14 to a TP (teaching pendant) emergency stop input 14, and a relay CR18 to a panel emergency stop input 18, and when each input is closed, the contacts CR17*a*, CR14*a*, CR18*a* are closed. The contacts CR16*a*, CR17*a*, CR14*a*, and CR18*a* of the relays closed by the closed circuit signal inputs from these safety devices such as emergency stop push-button switches and door switches (these are called safety circuit relays) are all connected in series, and one end is connected, in this embodiment, to a +24 V line.

The operation is described below according to FIG. 1.

When the teaching pendant enable switch (hereinafter called TP enable switch) 10 is closed, the operation for turning on the servo power source is enabled at the teaching pendant 4 side, and when the TP enable switch 10 of the teaching pendant 4 is opened, the operation for turning on the servo power source is enabled at the side of the front panel 7 of the robot control device 3 and external console 6, which is realized by changeover controlled by the central processing unit (CPU) of the control device.

When the TP enable switch 10 of the teaching pendant 4 is closed, the CPU set the teach disable signal 19 in low logic, and the relay coil CR1 is not energized, and the contact CR1*a* is opened and the contact CR1*b* is closed. When the dead-man's switch is pressed in this state, one signal line 11*a* of the dead-man's switch 11 of the teaching pendant 4 is connected to the grounding line PG through one contact of the dead-man's switch 11 and relay CR1*b*. Since the signal line 11*a* is also connected to the CPU through photo coupler, the CPU recognizes that one contact of the dead-man's switch 11 is closed. Besides, the other signal line 11*b* of the dead-man's switch 11 is also connected to the grounding line PG through two contacts of the dead-man's switch 11 and relay contact CR1*b*. Since the signal line 11*b* is connected to the CPU through photo coupler, it is also recognized that the other contact of the dead-man's switch 11 is closed. Thus, when the CPU recognizes that the two contacts of the dead-man's switch 11 are both closed, the CPU sets the servo power source ON signal 13 in high logic. As far as there is no other factor for impeding supply of servo power source, for example, unless the safety fence door 5 is open and the door switch is open, or any one of the emergency stop inputs is open, all safety circuit relay contacts are closed. When the servo power source ON signal 13 comes in high logic, the relay CR13 is energized, and the contact CR13*a* is closed. When the dead-man's switch 11 is in ON state, the relay coil CR2 is energized, and its contact CR2*a* is closed. Since the contact CR13*a* and contact CR2*a* are connected in series to the safety circuit relay contacts, +24 V is applied to the line of the servo power source ON enable signal 12 through the group of these contacts in series connection. Only when a voltage is applied to the line of this servo power source ON enable signal 12, the servo power source is turned on.

In the embodiment of the invention, the CPU is always monitoring the state of two contacts of the dead-man's switch 11 by judging if the states of two signal lines 11*a* and 11*b* are matched or not. That is, if the two signal lines 11*a* and 11*b* are not matched, it is judged that the contact of the dead-man's switch 11 is fused, and the servo power source ON signal 13 is not set in high logic, and hence an enable signal does not appear in the line of the servo power source ON enable signal 12, and the servo power source is not turned on, and the robot main body does not work. Thus, the matched state of the signal line 11*a* and signal line 11*b* is always monitored, and if miss-matching is judged, the supply of servo power source is stopped immediately.

To generate an enable signal in the line of the servo power source ON enable signal 12 in the closed contact state of the dead-man's switch 11, the TP enable switch 10 must be closed, the circuit system connected thereto should be active, and matching with the CPU must be achieved. Incidentally, by using a circuit capable of judging matched state of the signal line 11*a* and signal line 11*b*, a safety device having similar functions can be realized without using CPU.

Thus, according to the constitution of the first embodiment of the safety device of the industrial robot of the invention, if the contact of the dead-man's switch is fused and the circuit remains closed although the teaching operator has released the dead-man's switch, the CPU detects the fusion of the contact of the dead-man's switch itself, and the servo power source is cut off, and the servo motor is braked to stop the robot immediately, so that the teaching operator can be protected against danger.

A second embodiment of the safety device of industrial robot of the invention is described below. In FIG. 1, different from the conventional safety device of industrial robot, the invention comprises a switch having two contacts working simultaneously as an over-travel switch 15 provided in the robot main body 1. The two contacts of the over-travel switch 15 are connected in series, and one end is connected to the grounding line PG, and other end is connected to the CPU through photo coupler by way of signal line 15*b*. Moreover, the connection point of the two contacts is connected to the CPU through photo coupler by way of signal line 15*a*.

The over-travel switch 15 remains in closed state of the two contacts unless the robot main body 1 gets out of the moving range defined by the software due to some abnormality, and the CPU recognizes that the signal line 15*a* is connected to the grounding line PG through one contact of the over-travel switch 15. The signal line 15*b* is also connected to the grounding line PG through two contacts of the over-travel switch 15, which is recognized by the CPU, The CPU is always monitoring the state of these two signal lines 11*a*, 11*b*, and when the states of the two lines 11*a* and 11*b* are miss-matched, the CPU judges fusion of contact of the over-travel switch 15. When detecting abnormality of contact of the over-travel switch 15, the CPU changes over the servo power source ON signal 13 to low logic, the relay coil CR13 is de-energized, the contact CR13*a* is opened, the line of the servo power source ON enable signal 12 has no voltage, and the servo power source is cut off.

Incidentally, by using a circuit capable of judging matched state of the signal line 15*a* and signal line 15*b*, a safety device having similar functions can be realized without using CPU.

Thus, according to the constitution of the second embodiment of the safety device of the industrial robot of the invention, if the contact of the over-travel switch is fused and the circuit remains closed although the industrial robot is getting out of the normal working range, the CPU detects the fusion of the contact of the over-travel switch itself, and the servo power source is cut off, and the servo motor is braked to stop the robot immediately, so that the teaching operator can be protected against danger, and mechanical damage of the robot can be avoided.

A third embodiment of the safety device of industrial robot of the invention is described below. As shown in FIG. 1, same as in the prior art, normally open contacts of relays being energized by receiving input signals of normally closed contacts of push-OFF switch, that is, the safety circuit relay contacts are all connected in series.

Generally, the push-OFF switch is a switch capable of changing the contact state by manual operation, and in this type of switch, there is no problem of contact fusion. There is, however, possibility of occurrence of fusion in the contacts CR18*a*, CR14*a*, CR17*a* and CR16*a* of the safety circuit relays connecting the +24 V power source line and the line of the servo power source ON enable signal 12. To detect fusion in these relay contacts, in the third embodiment of the safety device of industrial robot of the invention, the connection point of the adjacent relay contacts CR18*a* and CR14*a* is connected to the CPU through photo coupler, the connection point of CR14*a* and CR17*a* is connected to the CPU through photo coupler, and similarly all connection points of contacts of the adjacent safety circuit relays are connected to the CPU through photo coupler.

In thus constituted third embodiment of the safety device of industrial robot, when a panel stop input 18 is in closed circuit state, the signal line 18*a* is connected to the grounding line PG through the input unit of the panel stop signal 18, and the signal line 18*a* is connected to the CPU through photo coupler, so that the CPU recognizes that the state of the panel emergency stop input 18 is in low logic, and its input unit is judged to be closed. On the other hand, one end of the relay contact CR18*a* is connected to a +24 V DC power source, and the signal line 18*b* is connected to the CPU through photo coupler, and therefore when the contact CR18*a* is in closed state, the CPU recognizes that the input from the signal line 18*b* is in low logic, and the contact 18*a* is judged to be closed. When the panel emergency stop input 18 is opened, the relay coil CR18 is de-energized, and its contact CR18*a* is opened, and the signal lines 18*a* and 18*b* are both in high logic. If, although the relay coil CR18 is de-energized, when the signal line 18*b* is recognized to be low logic, the CPU judges fusion of the relay contact 18*a*.

Next, the contact fusion of the relay contact CR14*a* is detected by presence or absence of matching of the state of the signal line 14*a* connected to the TP emergency stop input 14 and the signal line 14*b* connected to the relay contact CR14*a*. Similarly, the state of contacts CR17*a* and CR16*a* of other safety circuit relay is judged by matching of the state of the signal line connected to the contact and the signal line connected from each safety device to the input unit.

However, since the contacts of safety circuit relays are connected in series, depending on the open or closed state of the contact close to the +24 V DC power source, the open or closed state of the contact at a remoter side from the +24 V DC power source is not judged correctly. To avoid this demerit, in actual processing, priority order is determined in detection process of fusion by the CPU. In the embodiment shown in FIG. 1, the detection priority order is, from the highest, the signal line 18*a* of panel emergency is stop input 18, signal line 14*a* of TP emergency stop signal 14, signal line 17*a* of external emergency stop signal 17, and signal line 16*a* of door switch input 16, and when input is made in any signal line, matching is judged only if there is no input in the signal of the higher priority order.

Such monitoring of matching is repeated in a short period, and when logic miss-matching is detected twice consecutively, the CPU judges that fusion of relay contact occurs, and the servo power source ON 13 signal is inverted to low logic, and the relay contact CR13*a* is opened to cancel the servo power source ON enable signal 12. Meanwhile, the period of monitoring of matching is a time interval capable of avoiding effects of bouncing when opening or closing the relay contact.

Incidentally, by using a circuit capable of judging matched state of the signal line connected from each safety device to the input terminals and the-signal line connected to each contact, a safety device having similar functions can be realized without using CPU.

Thus, according to the constitution of the third embodiment of the safety device of the industrial robot of the invention, if the contact of the relay composing the safety circuit is fused and the contact remains closed, the CPU detects the fusion of the contact of the relay composing the safety circuit itself, and the servo power source is cut off, and the servo motor is braked to stop the robot immediately, and therefore if the contact of the relay for composing the safety circuit is fused, the robot is stopped in advance, thereby avoiding the very dangerous state of failure of stopping of the robot in spite of manipulation of emergency stop push-button switch.

What is claimed is:

1. A safety device for terminating power to an electrical system, said safety device comprising:

a switch having a first contact which is connected between a first terminal and a second terminal and a second contact which is connected between the second terminal and a grounding line, the first terminal providing a first signal and the second terminal providing a second signal, the switch coupling the electrical system to a power source when both the first and second contacts are closed and decoupling the electrical system from the power source when both the first and second contacts are open;

processing means for comparing the first signal with the second signal; and a relay for disconnecting the power source from the electrical system based on the result of said comparison performed by the processing means, wherein when the first signal is substantially different from the second signal, the relay disconnects the power source from the electrical system.

2. A safety device for terminating power according to claim 1, wherein the switch is a dead-man's switch operable by a push button.

3. The safety device according to claim 2, wherein the power source is decoupled from the electrical system when said push-button is released.

4. A safety device for terminating power according to claim 1, wherein the switch is an over travel-switch, the over-travel switch coupling the electrical system to a power source when both the first and second contacts are closed and decoupling the electrical system from the power source when at least one of the first and second contacts are open.

5. A safety device for terminating power according to claim 1, wherein the processing means outputs a logic low signal when the result of the comparison indicates that the first signal is substantially different from the second signal, and the relay disconnects the power source from the electrical system when the processing means outputs the logic low signal.

6. The safety device according to claim 5, wherein the processing means outputs a logic high signal when the result of the comparison indicates that the first signal is substantially equal to the second signal, and the relay connects the power source to the electrical system when the processing means outputs the logic high signal.

7. A safety device for terminating power according to claim 1, wherein the first and second contacts are mechanically coupled together.

8. A safety device for terminating power to an electrical system when fusion occurs in a contact, said safety device comprising:

a switch having a first contact which is connected between a first terminal and a second terminal and a second contact which is connected between the second terminal and a grounding line, the first terminal providing a first signal and the second terminal providing a second signal, the switch coupling the electrical system to a power source when both the first and second contacts are closed and decoupling the electrical system from the power source when both the first and second contacts are open;

processing means for comparing the first signal with the second signal; and a relay for disconnecting the power source from the electrical system based on the result of said comparison performed by the processing means, wherein when the first signal becomes substantially different from the second signal because of fusion in one of said contacts, the relay disconnects the power source from the electrical system.

* * * * *

UNITED STATES PATENT AND TRADE MARK OFFICE

CERTIFICATE OF CORRECTION

PATENT NO. : 6,051,894
DATED : April 18, 2000
INVENTOR(S) : Shimogama

It is certified that error appears in the above-identified patent and that said Letters Patent is hereby corrected as shown below:

Cover page, item [57] Abstract, delete the abstract in its entirety and insert:

-- In an industrial robot safety device, a switch, having two contacts working simultaneously, is used as the dead-man's switch provided in the teaching pendant. By monitoring the open or closed state of the two contacts, fusion of contact is judged by mis-matching of the opening and closing action, and the operation of the robot is stopped immediately. Besides, as an over-travel switch for actuating when the robot main body gets out of the normal moving range, a switch having two contacts is used, and by monitoring the open or closed state of the two contacts, fusion of contact is judged by a mis-match between the opening and closing state, and the operation of the robot is stopped immediately. Moreover, the energized state of the coils of the relays is individually detected, as well as the open and closed state of these relay contacts. The fusion of contact is judged by the mismatching of the coil's energized state and the open and closed state of the contacts, so that the operation of the robot is stopped immediately.--

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*